US006807525B1

(12) United States Patent
Li et al.

(10) Patent No.: US 6,807,525 B1
(45) Date of Patent: Oct. 19, 2004

(54) SID FRAME DETECTION WITH HUMAN AUDITORY PERCEPTION COMPENSATION

(75) Inventors: Dunling Li, Rockville, MD (US); Gokhan Sisli, Bethesda, MD (US); Daniel Thomas, Germantown, MD (US)

(73) Assignee: Telogy Networks, Inc., Germantown, MD (US)

( * ) Notice: Subject to any disclaimer, the term of this patent is extended or adjusted under 35 U.S.C. 154(b) by 611 days.

(21) Appl. No.: 09/699,366

(22) Filed: Oct. 31, 2000

(51) Int. Cl.[7] ..... G10L 11/06
(52) U.S. Cl. ..... 704/215
(58) Field of Search ..... 704/226–228, 704/233, 208, 214

(56) References Cited

U.S. PATENT DOCUMENTS 5,812,965 A * 9/1998 Massaloux ..... 704/205

* cited by examiner

*Primary Examiner*—Susan McFadden
*Assistant Examiner*—Michael N. Opsasnick
(74) *Attorney, Agent, or Firm*—Warren L. Franz; W. James Brady; Frederick J. Telecky, Jr.

(57) ABSTRACT

A method to reduce the amount of bandwidth used in the transmission of digitized voice packets is described. The method is used to reduce the number of transmitted packets by suspending transmission during periods of silence or when only noise is present. The system determines if a background noise update is warranted based on human auditory perception factors instead of an artificial limiter on excessive silence insertion descriptor packets. The system searches for characteristics in the perceptual changes of background noise instead of analyzing speech for improved audio compression. The invention weighs factors affecting the perception of sound including frequency masking, temporal masking, loudness perception based on tone, and auditory perception differential based on tone.

17 Claims, 10 Drawing Sheets

SID FRAME DETECTION WITH HUMAN AUDITORY PERCEPTION COMPENSATION

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to bandwidth improvements in digitized voice applications when no voice is present. In particular, the invention suggests that improved estimation of background noise during interruptions in speech leads to less bandwidth consumption.

Voice over packet networks (VOPN), require that the voice or audio signal be packetized and then be transmitted. The analog voice signal is first converted to a digital signal and is compressed in the form of a pulse code modulated (PCM) digital stream. As illustrated in FIG. 1, the PCM stream is processed by modules of the gateway, such as echo cancellation (EC) 10, voice activity detection (VAD) 12, voice compression (CODEC) 14, protocol configuration 16, etc.

Various techniques have been developed to reduce the amount of bandwidth used in the transmission of voice packets. One of these techniques reduces the number of transmitted packets by suspending transmission during periods of silence or when only noise is present. Two algorithms, i.e., the VAD algorithm followed by the Discontinuous Transmission (DTX) algorithm, achieve this process. In a system where these two algorithms exist and are enabled, VAD 12 makes the "voice/no voice" selection as illustrated in FIG. 1. Either one of these two choices is the VAD algorithm's output. If voice (active) is detected, a regular voice path is followed in the CODEC 14 and the voice information is compressed into a set of parameters. If no voice (inactive) is detected, the DTX algorithm is invoked and a Silence Insertion Descriptor (SID) packet 18 is transmitted at the beginning of this interval of silence. Aside from the first transmitted SID 18, during this inactive period, DTX analyzes the background noise changes. In case of a spectral change, the encoder sends a SID packet 18. If no change is detected, the encoder sends nothing. Generally, SID packets contain a signature of the background noise information 20 with a minimal number of bits in order to utilize limited network resources. On the receiving side, for each frame, the decoder reconstructs a voice or a noise signal depending on the received information. If the received information contains voice parameters, the decoder reconstructs a voice signal. If the decoder receives no information, it generates noise with noise parameters embedded in the previously received SID packet. This process is called Comfort Noise Generation (CNG). If the decoder is muted during the silent period, there will be sudden drops of the signal energy level, which causes unpleasant conversation. Therefore, CNG is essential to mimic the background noise on the transmitting side. If the decoder receives a new SID packet, it updates its noise parameters for the current and future CNG until the next SID is received.

In ITU standard G.729 Annex B, the DTX and CNG algorithms are designed to operate under a variety of levels and characteristics of speech and noise, ensuring bit rate savings and no degradation in the perceived quality of sound. Though the G.729 Annex B SID frame detection algorithm yields smooth background noise during non-active periods, it detects a significant percentage of SID frames even when the background noise is almost stationary. In a real VOPN system, G.729 Annex B generates numerous SID packets continuously, even when the background noise level is very low in dB. One reason for this is that the SID detection algorithm is too sensitive to very low level background noise. Another reason is the effects of imperfect EC. The output signal of EC may have bursts or non-stationary characteristics in low level noise, even when its input noise is stationary.

Since SID frames have considerably fewer payload bits than voice packets, generating many SID packets should theoretically not create bandwidth problems. However, both voice and SID packets 22 must have packet headers 24 in VOPN applications (FIG. 2.). The header length is the same for voice and SID packets. Sometimes the header 24 occupies most of the bandwidth in a SID packet 22. For instance, in RTP protocol, the header length is 12 bytes. One SID frame contains 2 bytes and a voice frame requires 10 bytes in a G.729 codec. Although SID frame bit rate is 20% of the full bit rate in G.729 codec, when the headers 24 are appended to the packet, the SID packet length with RTP header is about 70% of voice packet length with header. Therefore, it is very important for bandwidth savings to reduce the number of SID packets while preserving sound quality.

SUMMARY OF THE INVENTION

The SID detection algorithm of G.729 Annex B is based on spectral and energy changes of background noise characteristics after the last transmitted SID frame. The Itakura distance on the linear prediction filters is used to represent the spectral changes. When this measure exceeds a fixed threshold, it indicates a significant change of the spectrum. The energy change is defined as the difference between the quantized energy levels of the residual signal in the current inactive frame and in the last SID frame. The energy difference is significant if it is exceeds 2 dB. Since the thresholds of SID detection are fixed and on a crude basis, the generation of an excess number of SID frames is anticipated. Therefore, a SID update delay scheme is used to save bandwidth during nonstationary noise; a minimum spacing of two frames is imposed between the transmission of two consecutive SID frames. This method artificially limits the generation of SID frames.

The present invention creates a method to determine if a background noise update is warranted, and is based upon human auditory perception (HAP) factors, instead of an artificial limiter on the excessive SID packets. The acoustic factors, which characterize the unique aspects of HAP, have been known and studied. The applicability of perception, or psycho acoustic modeling, to complex compression algorithms is discussed in IEEE transactions on signal processing, volume 46, No. 4, April 1998; and in the AES papers of Frank Baumgarte, which relate to the applicability of HAP to digitizing audio signals for compressed encoded transmission. Other papers recognize the applicability of HAP to masking techniques for applicability to encoding of audio signals.

While some of these works acknowledge the applicability of HAP when compressing high fidelity acoustic files for efficient encoding, they do not recognize the use of HAP in SID detection, (i.e. background noise perceptual change identification, in voice communications). The present invention observes that modeling transitions, based upon HAP, can reduce the encoding of changes in background noise estimation, by eliminating the need to encode changes imperceptible to the HAP system. The present invention does not analyze speech for improved audio compression, but instead searches for characteristics in the perceptual changes of background noise.

HAP is often modeled as a nonlinear preprocessing system. It simulates the mechanical and electrical events in the inner ear, and explains not only the level of dependent frequency selectivity, but also the effects of suppression and simultaneous masking. Many factors can affect the perception of sound, including: frequency masking, temporal masking, loudness perception based on tone, and auditory perception differential based upon tone. The factors of HAP can cause masking, which occurs when a factor apart from the background noise renders any change in the background noise imperceptible to the human ear. In a situation where masking occurs, it is not necessary to update background noise, because the changes are not perceptible. The present invention accounts for these factors, by identifying and weighing each factor to determine the appropriate level of SID packet generation, thus increasing SID detection efficiency.

The most responsive frequency for human perception, as illustrated in FIG. 3, is around 4.5 kHz. For sound to be perceptible to the human ear, as the frequency of a signal increases or decreases from 4.5 kHz, the sound level must increase in dB. This is illustrated by the threshold in quiet line 26. For example, a sound at 2 kHz would have to be 3 dB louder to be heard; a sound at 10 kHz would have to be 10 dB louder, while a sound at a frequency of 0.05 would have to be 47 dB greater. The threshold in quiet line, 26, illustrates the dB level necessary for audible perception.

Simultaneous masking, also called frequency masking, is a frequency domain phenomenon where a high level signal (masker) suppresses a low level signal (maskee) when they are in close range of frequency. FIG. 3, illustrates a 1 KHz pure tone masker and its masking threshold. The masking threshold, below which no signals are audible, depends on the sound pressure level and the frequencies of the masker and of the maskee. In FIG. 3, if a tone is generated at 1 kHz, it will not only block out any sound at the same frequency, but also blocks signals near 1 kHz. The masking threshold depicts the greatest masking near the generated tone, which diminishes rapidly as the sound departs from the detectable tone sound.

Temporal masking, including premasking and postmasking, is a time domain phenomenon, which occurs before and after a masking signal. Independent of any of the conditions of the masker, the presmasking lasts about 20 ms. However, the postmasking depends on the duration of the masker. In FIG. 4, a masking signal is initiated at time 0, and is maintained for 200 ms. The background noise is inaudible, by human perception, for the duration of the masking signal. Additionally, masking occurs prior to the signal for approximately 20 ms and last 50 to 200 ms after the signal.

The human ear exhibits different levels of response to various levels of loudness. As sound level increases, sensitivity becomes more uniform with frequency. This behavior is explained in FIG. 5. The present invention utilizes this principle as another masking feature.

BRIEF DESCRIPTION OF THE DRAWINGS

For a better understanding of the nature of the present invention, reference is had to the following figures and detailed description, wherein like elements are accorded like reference numerals, and wherein.

DETAILED DESCRIPTION OF PREFERRED EMBODIMENTS

The underlying principle of HAP-based SID frame detection is to detect the perceptible background noise change by measuring the HAP-based spectral distance changes as well as the energy level changes between the current frame and the previous SID frame. The present invention defines HAP-based spectral distance (D) as the weighted Line Spectral Frequency (LSF) distance between the current inactive frame and the previous SID frame. The selection of LSF to represent the frequency content of the signal is due to the fact that LSF parameters are available during SID detection for most CELP based codecs. Therefore, a reduction in spectral analysis computation is achieved.

Figure 6:
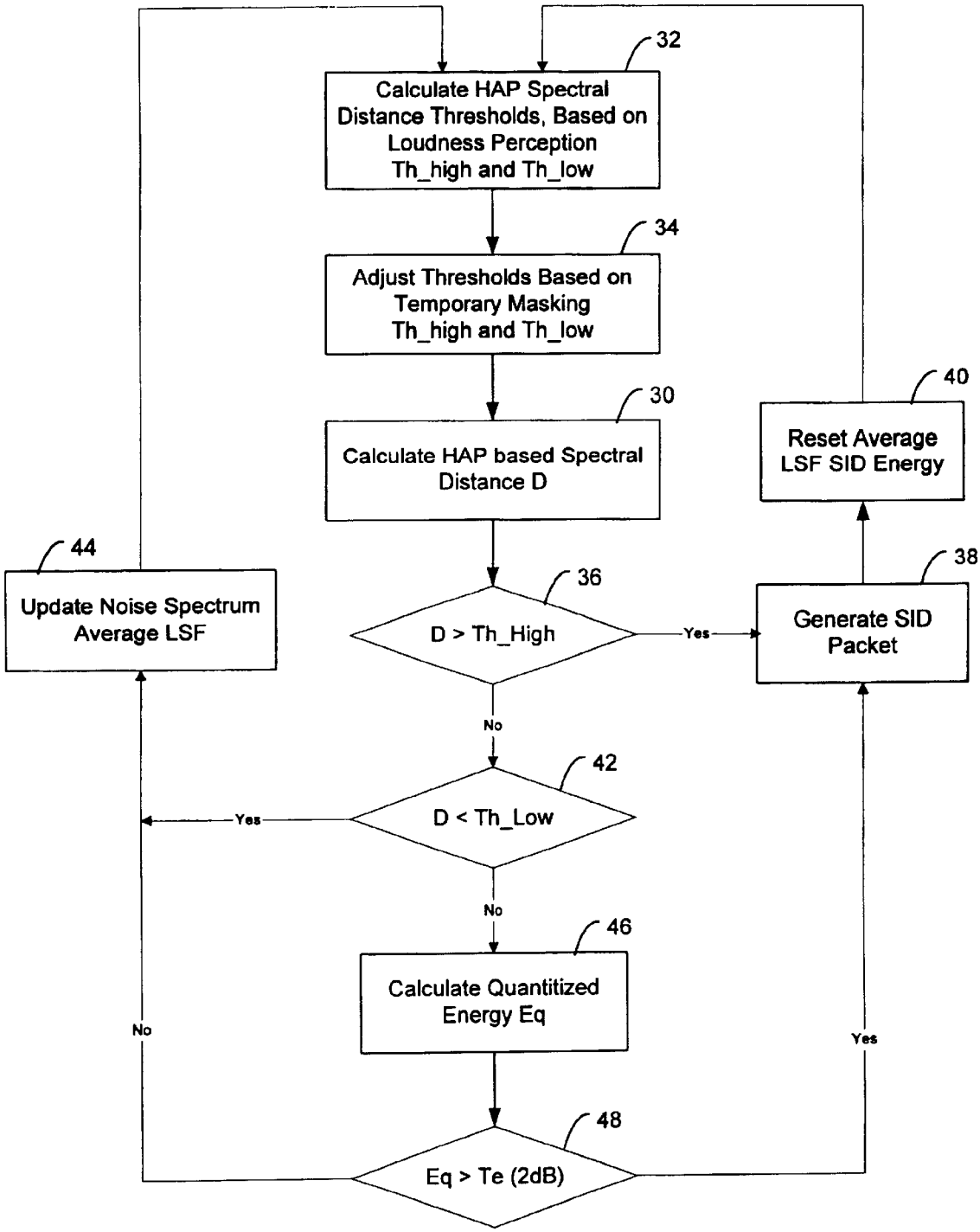
FIG. 6 is a functional flow diagram illustrating the process for identification of background noise estimations for generating SID

The flow diagram of this SID detection algorithm is illustrated in FIG. 6. The first step 30 in the beginning of the process is to calculate HAP-based spectral distance thresholds and signal energy levels for each frame by using equations (1), (2) and (3):

$$D = \sum_{i=1}^{10} w_1(i) w_m(i) \| AvgLSF(i) - SidLSF(i) \| \qquad \text{Equation (1)}$$

$$AvgLSF_{n+1}(i) = \begin{cases} \alpha AvgLSF_n(i) + (1-\alpha) LSF(i) & Ftype = 0 \\ LSF(i) & Ftype = 2 \end{cases} \qquad \text{Equation (2)}$$

$$\sum_{i=0}^{n} x^2(i) \qquad \text{Equation (3)}$$

Figure 1:
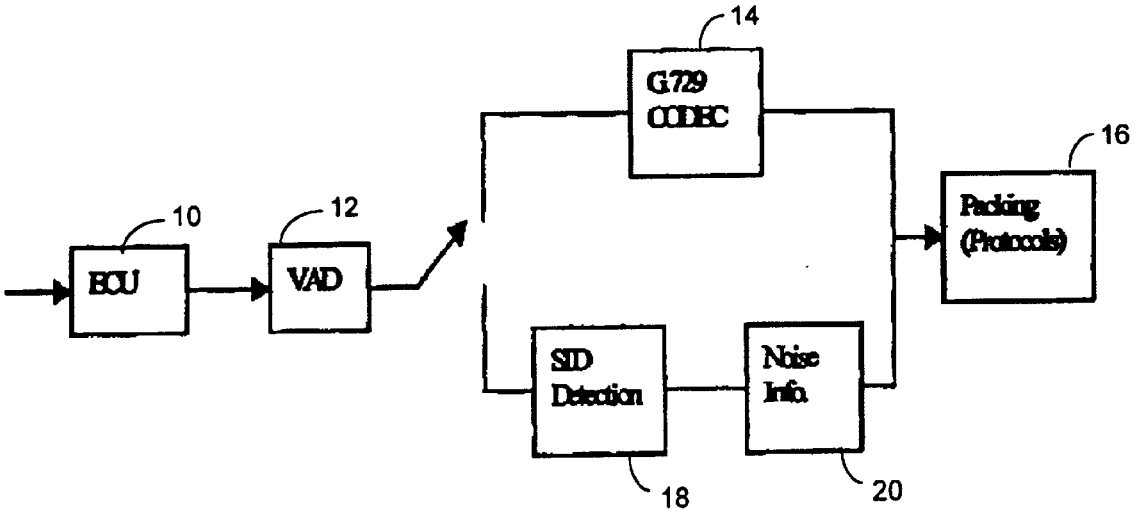
FIG. 1 is a functional block diagram illustrating the separate processing paths for voice, tone and silence.
Figure 2:
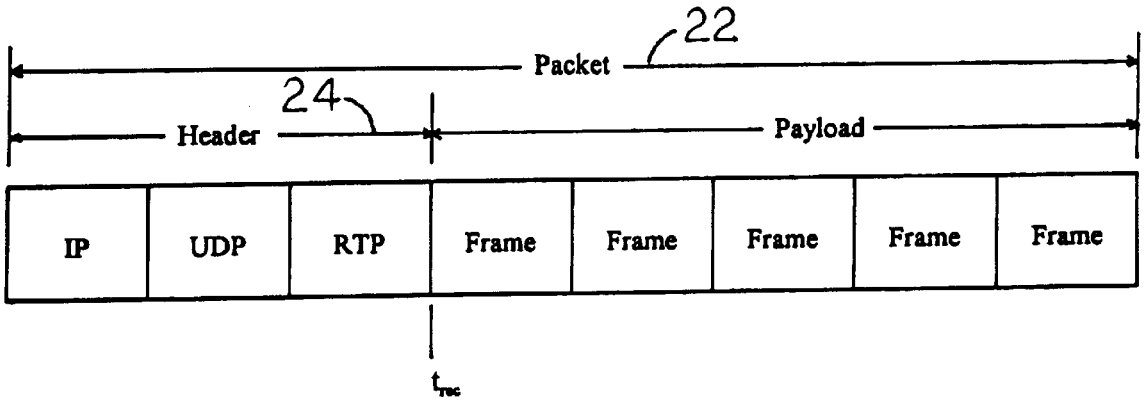
FIG. 2 is a diagram illustrating a typical packet.
Figure 3:
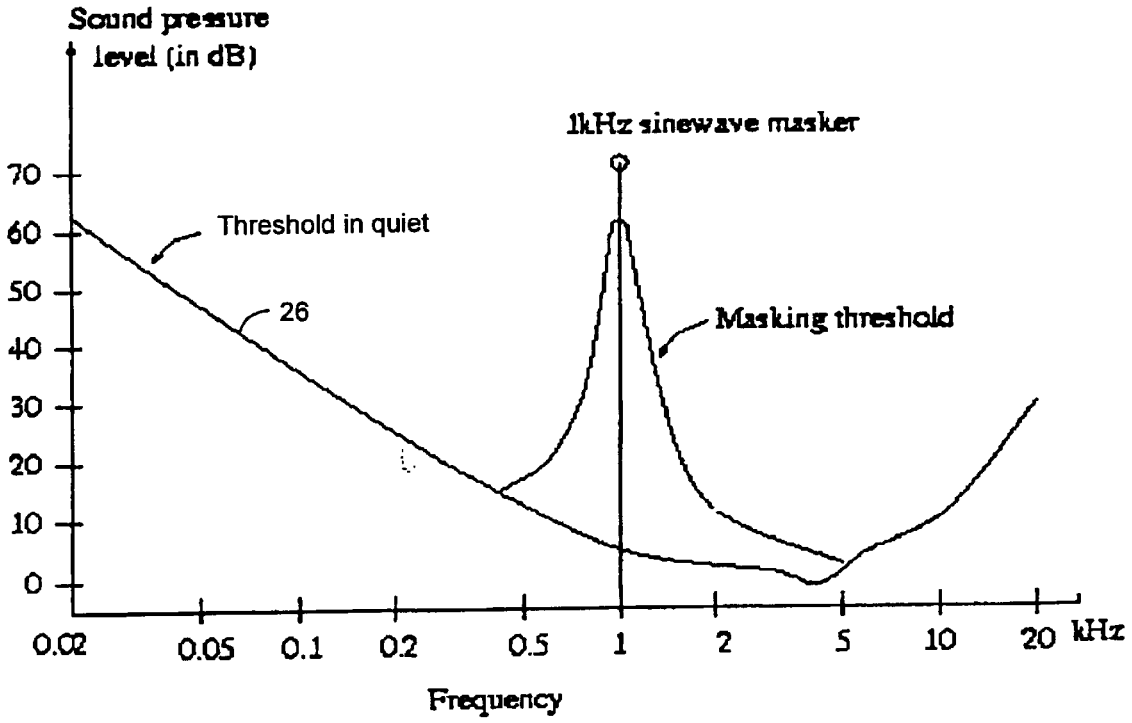
FIG. 3 is a graph illustrating frequency masking.
Figure 4:
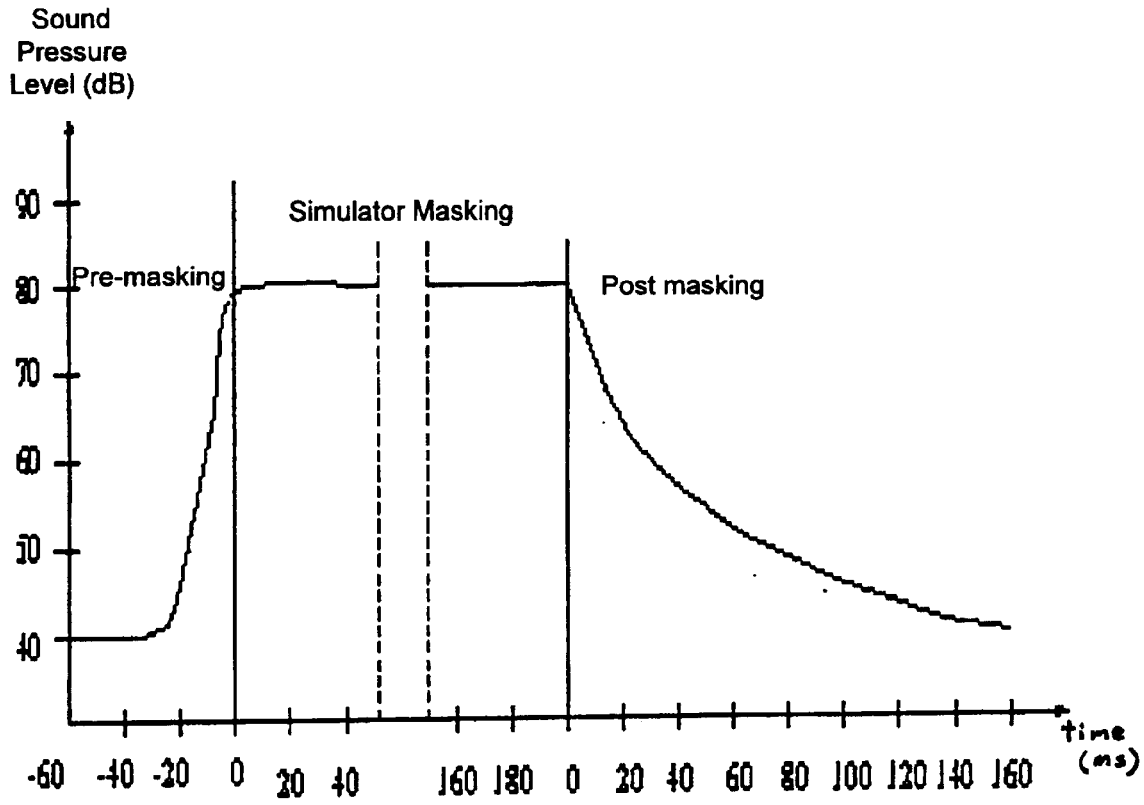
FIG. 4 is a graph illustrating temporal masking.
Figure 5:
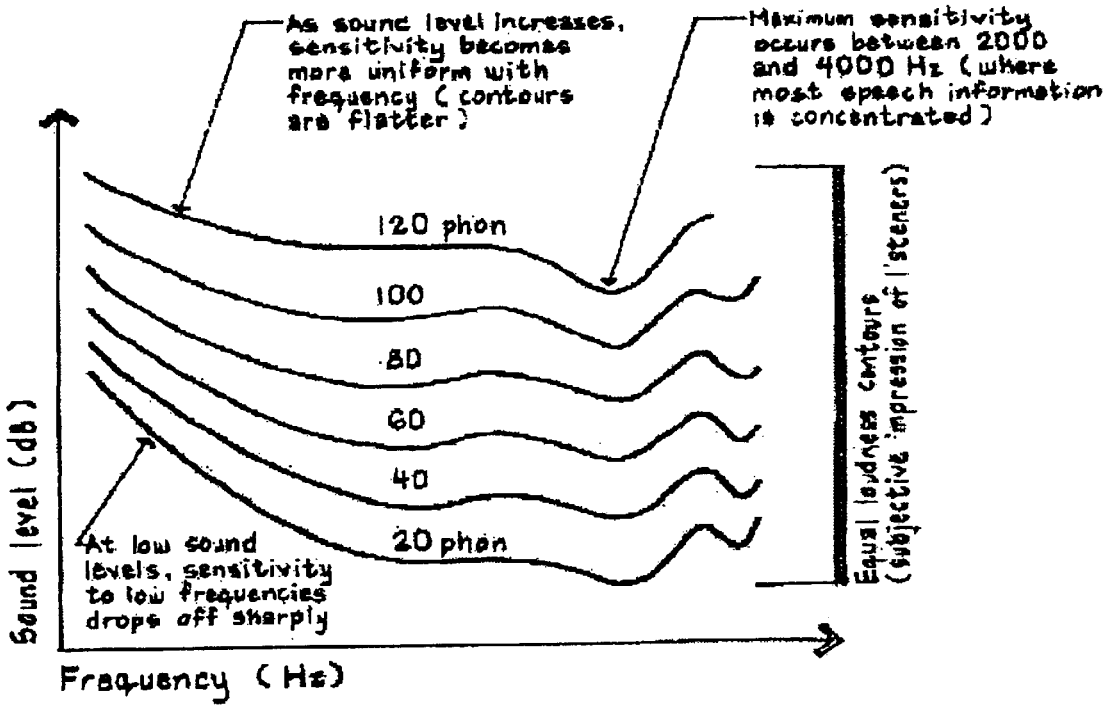
FIG. 5 is a graph illustrating human perception of loudness.
Figure 7:
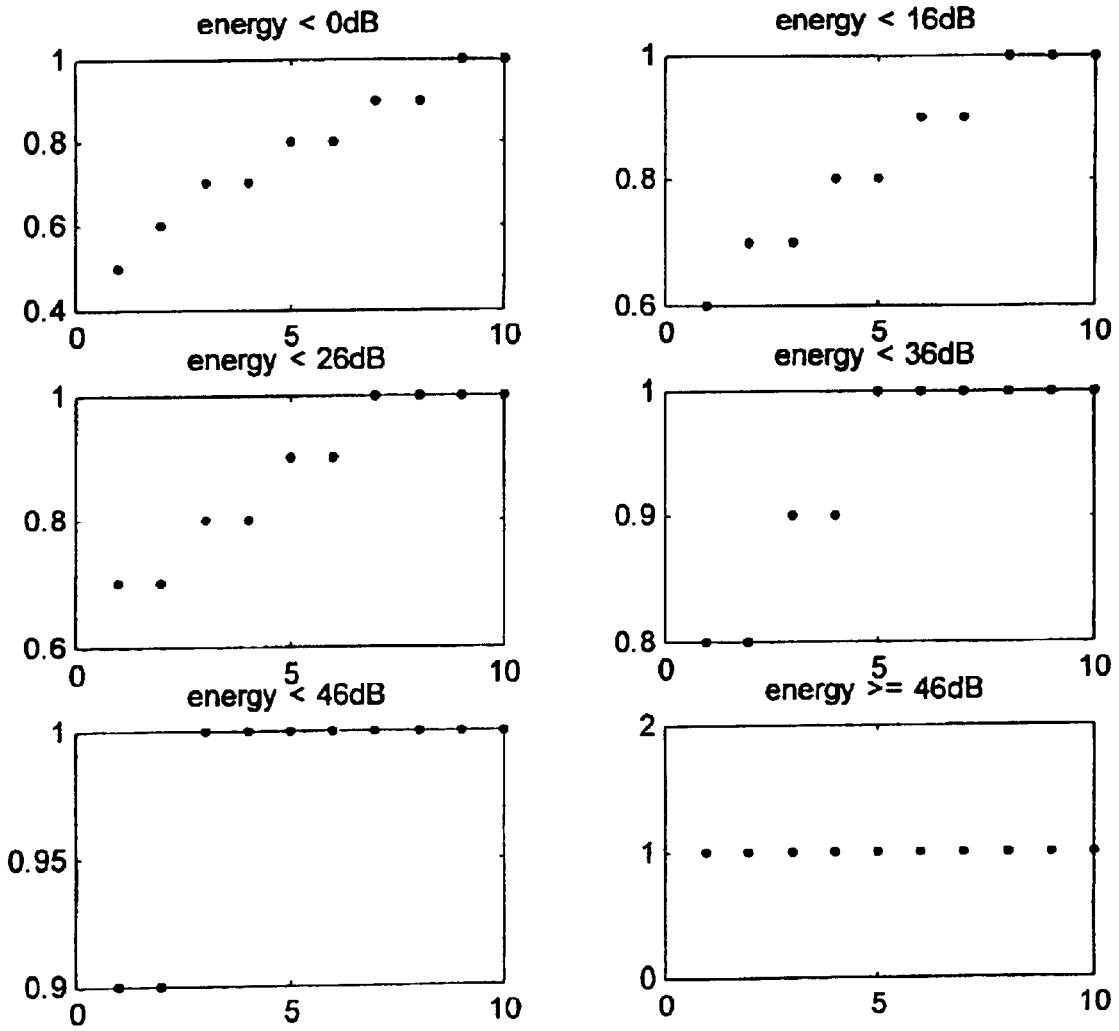
FIG. 7 is a graph illustrating HAP related weighting factor determination given various energy levels.

The HAP-based spectral distance is defined in equation (1), and FIG. 7 shows the selection of weighting factors ($w_m(i)$) given various energy levels. Weighting factors $w_m(i)$ are the weighting factors used in ITU-T G729 Annex B standard. The weighting factors are derived from FIG. 5. For low energy levels, thus low loudness levels, weighting factors increase as the frequency increases to balance the effects of different frequencies. As the loudness level increases, weighting factors become flat. The $w_m(i)$ values in FIG. 7 are experimentally selected.

Figure 8:
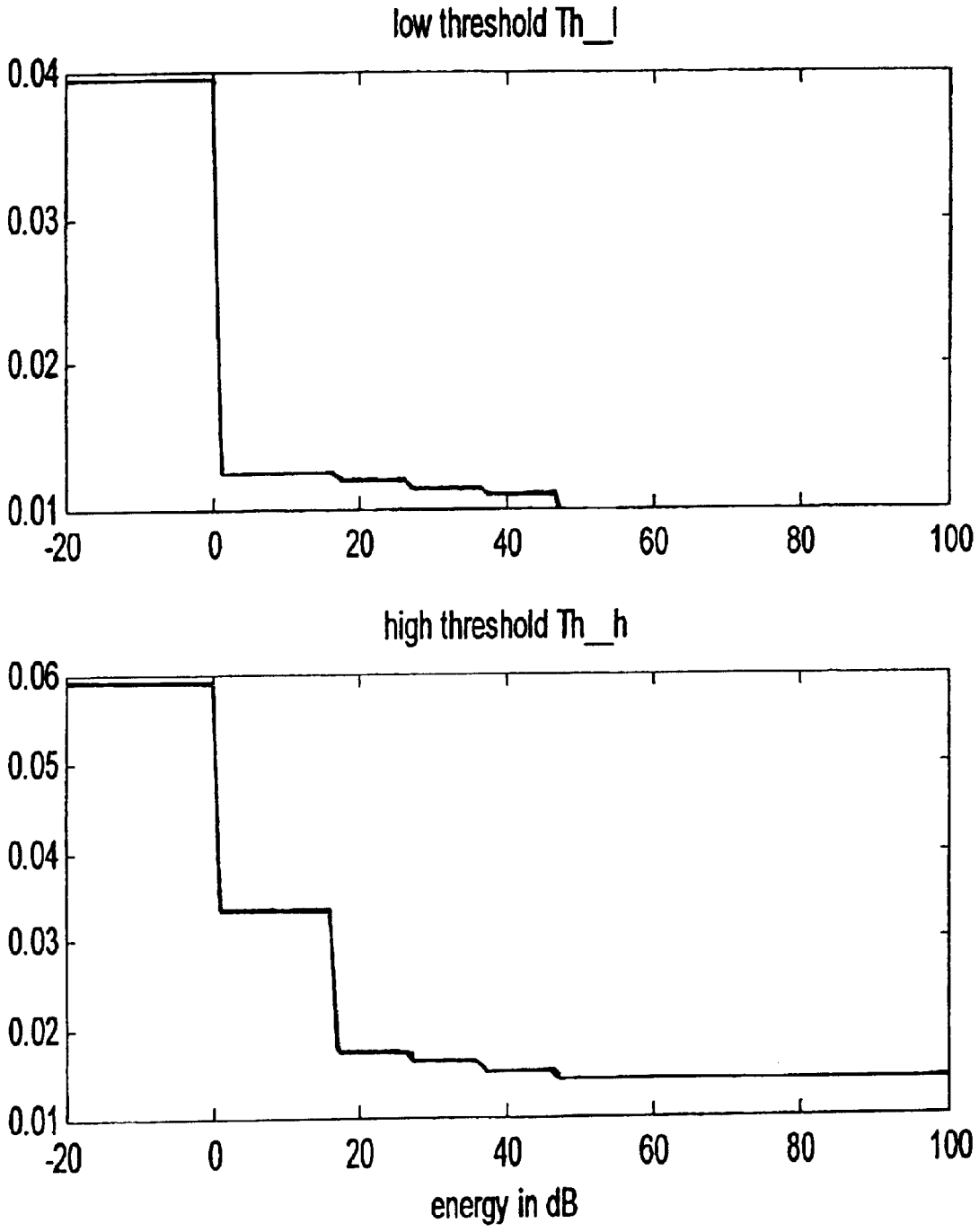
FIG. 8 is a graph illustrating loudness perception thresholds.

The algorithm establishes a set of criteria for the evaluation of signal changes to determine if the signal changes will be perceptible and/or significant to the human auditory response system. One pair in this decision is the HAP spectral distance thresholds based on loudness perception. They are denoted by th_h and th_l and vary depending on the energy of the frame as shown in FIG. 8. These figures are also derived by the arguments in FIG. 5. It is trivial to see that as the signal energy drops, the loudness drops, too. Thresholds at low loudness levels should be higher to compensate for the low sensitivity. Maximum sensitivity is at high loudness levels, therefore lower thresholds are selected for high loudness levels. The th_l and th_h values in FIG. 8 are experimentally selected.

These two thresholds are used in the updating process of temporal masking thresholds, th_high and th_low. Equations (3), (4), and (5), represent the HAP spectral distance threshold adaptation based on the temporary masking.

$$Thlow(n+1)=\alpha Thlow(n)+(1-\alpha)Th_l \quad \text{Equation (4)}$$

$$Thhigh(n+1)=\alpha Thhigh(n)+(1-\alpha)Th_h \quad \text{Equation (5)}$$

Figure 9:
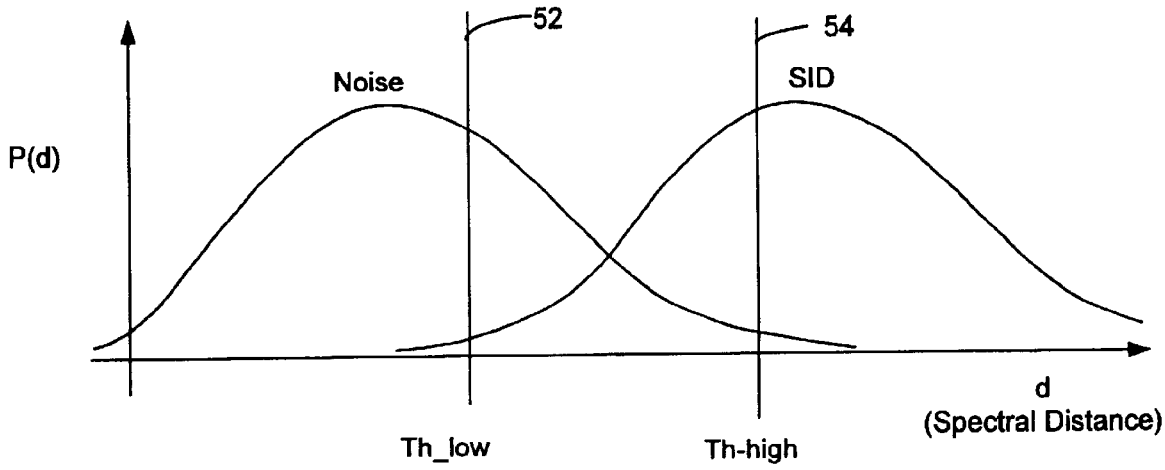
FIG. 9 is a Bayes estimator for the selection of SID generation given different thresholds.

Since the post masking is in the order of 50 to 200 ms, the time constant of above thresholds are chosen as 50 ms, i.e. a=¾ in current implementation. Th_high 50 and Th_low 52 are used in Bayes classifier as illustrated in FIG. 9.

FIG. 6 further illustrates that if the HAP-based spectral distance 30 is greater than the higher threshold th_high 36, a SID frame is detected 38. The average LSF energy is then reset 40 and is updated based on loudness perception 32 and temporary masking 34. If the distance 30 is less than the lower threshold th_low 42, the current frame is considered as a non-SID frame. If the spectral distance falls between th_high and th_low, then the quantized energy feature q 46 is introduced to decide if the current frame is a SID. If $E_q$>2 dB, then a SID packet 38 is detected. If $E_q$<2 dB, then average LSF noise spectrum is updated 44 prior to returning to re-calculating HAP spectral distance thresholds 32 and adjusting the thresholds 34.

Figure 10:
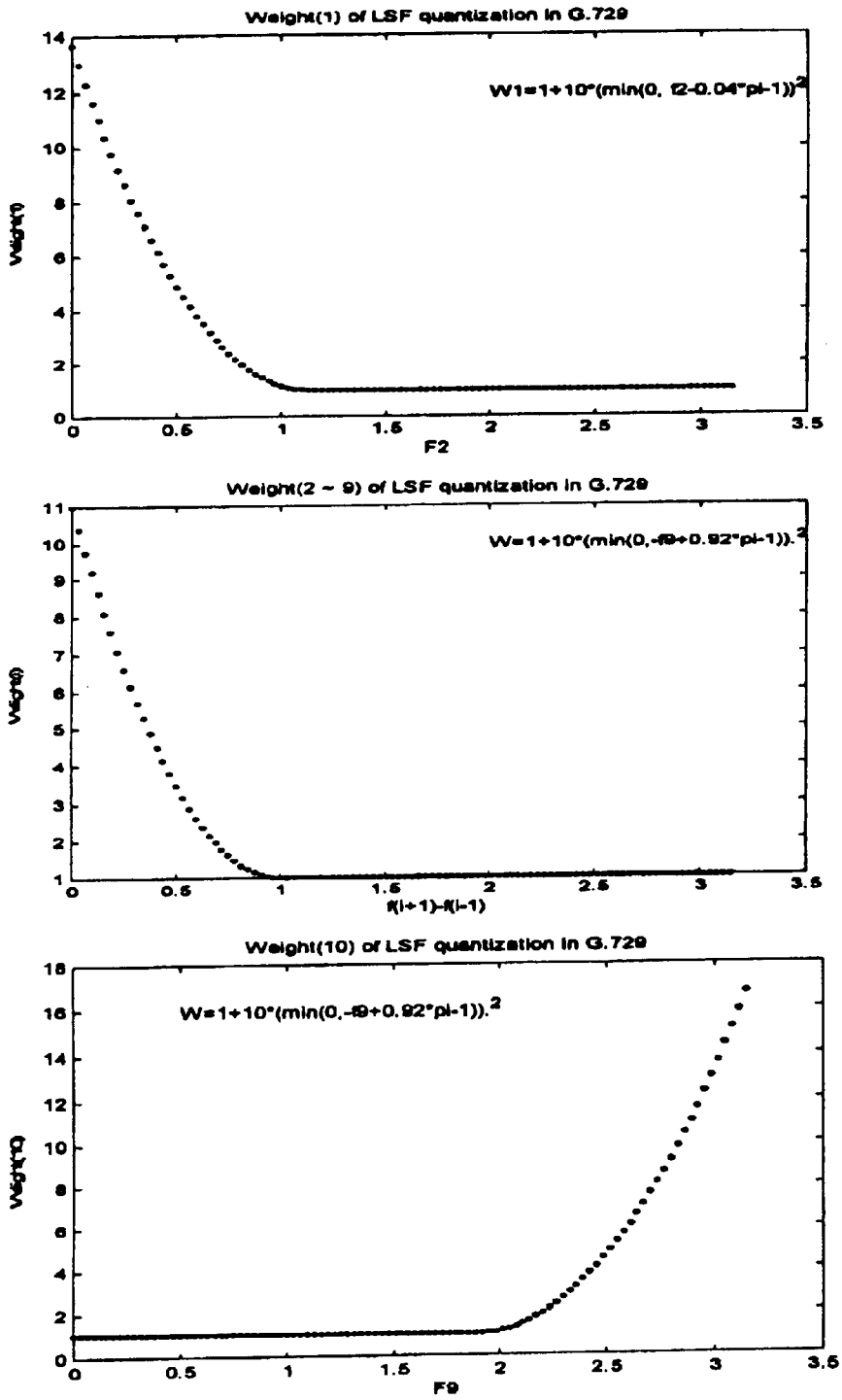
FIG. 10 contains graphs simulation results of the HAP-based SID detection and G.729 Annex B SID detection for clean speech.

The present invention is then able to reject those transitions which represent inaudible background level changes and is able to generate SID packets 38 corresponding to the perceptible changes in background noise. FIG. 10 illustrates simulation results of the HAP-based SID detection and G.729 Annex B SID detection for clean speech, with/without various added noise (babble, office or street noise) under different background noise levels. PAMS is used for objective measurements. The new algorithm either performs the same or outperforms the standard G729 Annex B SID detection algorithm in terms of YLQ in noisy conditions (Rows 7 through 15) with a significant SID percentage reduction. In other examples (Rows 1–6), although the new algorithm cannot perform the same quality as the standard SID detection algorithm, the SID reduction ratio is still significant and the YLQ difference is in a negligible range. Subjective tests also proved that there was no or insubstantial degradation in the quality.

TABLE 1

| | File Name | Noise level (dBm0) | Noise % | SID % over noise frames Standard | HAP | Ratio | YLQ STD | HAP | YLE STD | HAP |
|---|---|---|---|---|---|---|---|---|---|---|
| 1 | Tstseq1 | Clean | 51.40 | 16.57 | 7.6 | 2.18 | 3.35 | 3.37 | 4.25 | 4.30 |
| 2 | Tstseq2 | Noise only | 52.38 | 9.09 | 6.29 | 1.44 | | | | |
| 3 | Tstseq3 | −43 | 64.72 | 14.26 | 6.32 | 2.26 | 3.69 | 3.65 | 4.93 | 4.90 |
| 4 | Tstseq4 | −45 | 41.00 | 18.90 | 12.50 | 1.51 | 3.70 | 3.61 | 4.98 | 4.87 |
| 5 | Wdll | Clean | 72.06 | 18.49 | 4.27 | 3.917 | 3.85 | 3.83 | 5.0 | 5.0 |
| 6 | Wdlr | Clean | 28.57 | 18.69 | 11.31 | 1.65 | 4.02 | 3.99 | 5.0 | 5.0 |
| 7 | Wdll_b50 | −50 (babble) | 54.81 | 28.33 | 10.84 | 2.5 | 3.78 | 3.78 | 4.92 | 4.95 |
| 8 | Wdll_b60 | −60 | 57.10 | 27.16 | 10.97 | 2.47 | 3.83 | 3.83 | 4.99 | 5.0 |
| 9 | Wdll_b65 | −65 | 69.36 | 22.83 | 9.23 | 2.47 | 3.83 | 3.85 | 4.99 | 5.0 |
| 10 | Wdll_o50 | −50 (office) | 47.45 | 29.09 | 15.05 | 1.93 | 3.81 | 3.81 | 4.97 | 4.97 |
| 11 | Wdll_o60 | −60 | 54.85 | 27.57 | 14.28 | 1.93 | 3.83 | 3.84 | 5.0 | 5.0 |
| 12 | Wdll_o65 | −65 | 64.16 | 24.94 | 9.23 | 2.70 | 3.83 | 3.83 | 4.99 | 5.0 |
| 13 | Wdll_s50 | −50 (Street) | 69.13 | 12.60 | 5.23 | 2.40 | 3.85 | 3.85 | 5.0 | 5.0 |
| 14 | Wdll_s60 | −60 | 69.87 | 20.02 | 6.19 | 3.23 | 3.83 | 3.83 | 5.0 | 5.0 |
| 15 | Wdll_s65 | −65 | 71.53 | 16.15 | 3.57 | 4.51 | 3.85 | 3.85 | 5.0 | 5.0 |

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed:

1. A method to for silence insertion descriptor (SID) frame detection to determine if a background noise update is warranted in a digitized voice application based upon human auditory perception (HAP) factors, comprising:

detecting SID frames in a digitized voice application;

calculating HAP-based spectral distance thresholds for each said SID frame;

calculating HAP-based signal energy levels for each said SID frame;

calculating the HAP-based spectral distance changes between successive SID frames;

evaluating changes in said signal energy levels to determine if said changes will be perceptible or significant to the human auditory response system;

rejecting said signal energy levels representing inaudible background level changes; and generating SID packets corresponding to perceptible changes in background noise.

2. The method of claim 1, wherein:

said HAP-based spectral distance thresholds are experimentally selected and based on loudness perception that vary depending on the energy of said SID frames, the levels of said thresholds being higher at low loudness to compensate for low sensitivity, and the levels of said thresholds being lower at high loudness levels for maximum sensitivity.

3. The method of claim 1, wherein:

said calculating the HAP-based spectral distance changes and said signal energy levels is performed using weighting factors.

4. The method of claim 3, wherein:

said weighting factors are experimentally selected.

5. The method of claim 1, wherein:

said detecting SID frames in a digitized voice application includes detecting said SID frame when said HAP-based spectral distance is greater than an upper threshold;

detecting a non-SID frame when said spectral distance is below a lower threshhold; and detecting said SID frame when said spectral distance falls between said upper and said lower thresholds and said SID frame is above approximately two decibels.

6. A method to for silence insertion descriptor (SID) frame detection to determine if a background noise update is warranted in a digitized voice application based upon human auditory perception (HAP) factors, comprising:

detecting SID frames in a digitized voice application;

calculating HAP-based spectral distance thresholds for each said SID frame, said thresholds are experimentally selected and based on loudness perception that vary depending on the energy of said SID frames, the levels of said thresholds being higher at low loudness to compensate for low sensitivity, and the levels of said thresholds being lower at high loudness levels for maximum sensitivity;

calculating HAP-based signal energy levels for each said SID frame;

calculating the HAP-based spectral distance changes between successive SID frames;

evaluating changes in said signal energy levels to determine if said changes will be perceptible or significant to the human auditory response system;

rejecting said signal energy levels representing inaudible background level changes; and generating SID packets corresponding to perceptible changes in background noise.

7. A method for silence insertion descriptor (SID) frame detection to determine if a background noise update is warranted in a digitized voice application based upon human auditory perception (HAP) factors, comprising:

detecting SID frames in a digitized voice application;

calculating HAP-based acoustic factors of background noise signals for each said SID frame;

rejecting said background signals levels if changes in said HAP-based acoustic factors are imperceptible to a HAP system; and generating SID packets corresponding to changes in said HAP-based acoustic factors are perceptible to said HAP system, wherein said calculating comprises:

calculating HAP-based spectral distance changes between successive SID frames; and calculating HAP-based spectral distance thresholds for each said SID frame, wherein said thresholds are experimentally selected and based on loudness perception that vary depending on the energy of said SID frames, the levels of said thresholds being higher at low loudness to compensate for low sensitivity, and the levels of said thresholds being lower at high loudness levels for maximum sensitivity.

8. The method of claim 7, wherein said calculating comprises calculating HAP-based signal energy levels for each said SID frame, and said generating comprises evaluating changes in said signal energy levels of said background noise in said digitized voice application to determine if said changes will be perceptible or significant to said HAP system.

9. The method of claim 8, wherein, if said changes are perceptible or significant to the HAP system, then generating said SID packets corresponding to said perceptible or significant changes.

10. The method of claim 8, wherein, if said changes are imperceptible or insignificant to the HAP system, then rejecting said signal energy levels.

11. The method of claim 7, wherein said rejecting comprises rejecting said factors representing inaudible background level changes.

12. The method of claim 7, wherein said calculating the HAP-based spectral distance changes comprises calculating a weighted Line Spectral Frequency distance between a current inactive frame and a previous SID frame.

13. The method of claim 7, wherein said detecting said SID frames comprises:

detecting said SID frame when said HAP-based spectral distance is greater than an upper threshold;

detecting a non-SID frame when said spectral distance is below a lower threshhold.

14. The method of claim 7, wherein said detecting said SID frames comprises:

detecting said SID frame when said spectral distance falls between an upper threshold and a lower threshold.

15. The method of claim 14 wherein said detecting comprises detecting said SID frame when said SID frame is above approximately two decibels.

16. The method of claim 7, wherein said calculating said HAP-based acoustic factors comprises:

calculating HAP-based spectral distance changes of each SID frame using thresholds that are experimentally selected.

17. The method of claim 7, wherein said calculating said HAP-based acoustic factors comprises:

calculating signal energy levels of each SID frame using weighting factors that are experimentally selected.

* * * * *